US006461119B1

(12) United States Patent
Timuska

(10) Patent No.: US 6,461,119 B1
(45) Date of Patent: Oct. 8, 2002

(54) LIFT VALVE FOR A ROTARY SCREW COMPRESSOR

(75) Inventor: Karlis Timuska, Stockholm (SE)

(73) Assignee: Svenska Rotor Maskiner AB, Stockholm (SE)

( * ) Notice: Subject to any disclaimer, the term of this patent is extended or adjusted under 35 U.S.C. 154(b) by 0 days.

(21) Appl. No.: 09/786,658

(22) PCT Filed: Apr. 30, 1999

(86) PCT No.: PCT/SE99/00714

§ 371 (c)(1),
(2), (4) Date: Mar. 26, 2001

(87) PCT Pub. No.: WO00/19103

PCT Pub. Date: Apr. 6, 2000

(30) Foreign Application Priority Data

Sep. 29, 1998 (SE) ..... 9803292

(51) Int. Cl.[7] ..... F04B 49/00

(52) U.S. Cl. ..... 417/310; 417/201.2; 417/418; 418/201.2; 251/63

(58) Field of Search ..... 417/310, 201.2, 417/418; 137/565.35; 251/50

(56) References Cited

U.S. PATENT DOCUMENTS 1,974,225 A * 9/1934 Varley ..... 417/310
2,459,709 A * 1/1949 Lysholm ..... 290/2
4,304,258 A * 12/1981 Mitchell ..... 137/596.17
4,453,900 A * 6/1984 Schibbye et al. ..... 418/99
4,498,849 A * 2/1985 Schibbye et al. ..... 417/310
5,556,271 A * 9/1996 Zuercher et al. ..... 418/201.2

* cited by examiner

*Primary Examiner*—Charles G. Freay
*Assistant Examiner*—John F Belena
(74) *Attorney, Agent, or Firm*—Frishauf, Holtz, Goodman & Chick, P.C.

(57) ABSTRACT

The present invention relates to a variable capacity helical screw compressor for compressing a gaseous medium, usually air. The compressor includes at least one lift valve (1) which connects with a first compression chamber in the compressor. The lift valve (1) includes a valve housing (2), a valve head (6) which can move reciprocatingly in the valve housing (2), a valve stem (5) whose one end is connected to the valve head (6) and whose other end projects out of the housing (2), a valve body (7) that has a valve area (21) at the other end of the valve stem (5), said valve area (21) facing towards the first compression chamber, and a first passageway (28) whose opening (17) opens into the valve housing (2) adjacent a first side of the valve head (6) and whose other end is in selecive fluid contact with either a compressor outlet passageway or with a compressor inlet passageway, a second passageway (19) which connects the valve housing (2) in or adjacent to a second, opposite side of the valve head (6) with a second compression chamber. The compressor includes an elastic device (12) disposed between the other side of the valve head (6) and the valve housing (2), and the first and the second compression chambers are one and the same compression chamber.

8 Claims, 3 Drawing Sheets

LIFT VALVE FOR A ROTARY SCREW COMPRESSOR

The present invention relates toga variable capacity helical screw compressor for compressing a gaseous medium, usually air. This variation in capacity is achieved with a number of lift valves, normally four lift valves, which cause part of partially compressed air to be returned to the inlet.

One such compressor is known from U.S. Pat. No. 5,556,271A. The lift valve taught by this publication includes an arched valve area which in one end position of the valve forms part of the cylindrical rotor housing of the compressor and which in its other end position is spaced from the opening in the rotor housing with which it co-acts so that partially compressed air is able to leave the working chamber of the compressor and return to the inlet. This arched valve area means that said valve element may not be rotated about its axis. This problem has been solved, by providing the valve housing with a rod of square section which can move in a corresponding square or rectangular opening in the valve element on the opposite side of the valve area Despite this, it is highly probable that the valve element will be able to rotate about its axis after having been in use over a period of time, and therewith interfere with and cause damage to the rotor.

An object of the present invention is to avoid the problem associated with rotation of the valve element about its axis.

Another object is to provide a helical screw compressor that includes a valve element which has a valve area that enables the valve element to be rotated without damaging the rotor.

These objects are achieved with a helical screw compressor that is characterised by an elastic device disposed between the second side of the valve head and the cap of the valve housing, and is further characterised in that the first and the second compression chambers are one and the same compression chamber.

Preferred embodiments will be evident from the dependent Claims.

The present invention will now be described in more detail with reference to exemplifying embodiments thereof and also with reference to the accompanying drawings, in which FIG. 1 is a longitudinal section view of a known helical screw compressor;

Figure 1:
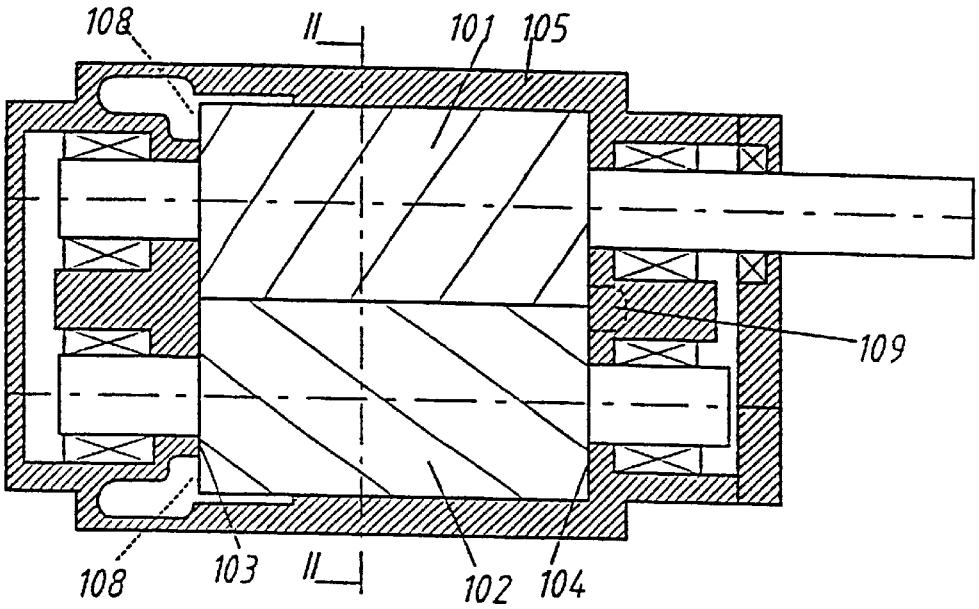
Fig. 1 PRIOR ART

The construction and working principle of a helical screw compressor will now be described briefly with reference to FIGS. 1 and 2.

A pair of mutually engaging helical rotors 101, 102 are rotatably mounted in a working chamber that is defined by two end walls 103, 104 and a barrel wall 105 extending therebetween. The barrel wall 105 has a form which corresponds generally to the form of two mutually intersecting cylinders, as evident from FIG. 1. Each rotor 101, 102 has several lobes 106 and 107 respectively, and intermediate grooves which extend helically along the rotor. One rotor, 101, is a male rotor type with the major part of each lobe 106 is located outwardly of the pitch circuit, and the other rotor, 102, is a female type rotor with which the major part of each lobe 107 is located inwardly of the pitch circle. The female rotor 102 will normally have more lobes than the male rotor 101. A typical combination is one in which the male rotor 101 has four lobes and the female rotor 102 has six lobes.

The gas to be compressed, normally air, is delivered to the working room of the compressor through an inlet port 108 and is then compressed in V-shaped working chambers defined between the rotors and the chamber walls. Each working chamber moves to the right in FIG. 1 as the rotors 101, 102 rotate. The volume of a working chamber thus decreases continuously during the latter part of its cycle, subsequent to communication with the inlet port 108 having been cut off. The gas is therewith compressed and the compressed gas leaves the compressor through an outlet port 109. The outlet to inlet pressure ratio is determined by the built-in volumetric relationship between the volume of a working chamber immediately after its communication with the inlet port 101 has been cut off and the volume of said working chamber when it begins to communicate with the outlet port 109.

Figure 2:
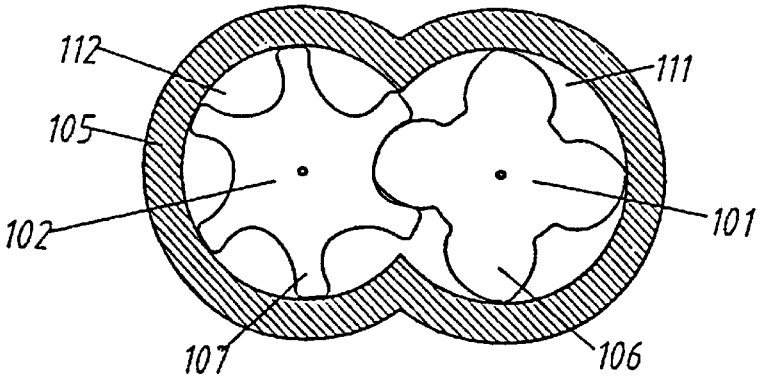
Fig. 2 PRIOR ART
FIG. 2 is a sectional view taken on the line II—II in FIG. 1.
Figure 3:
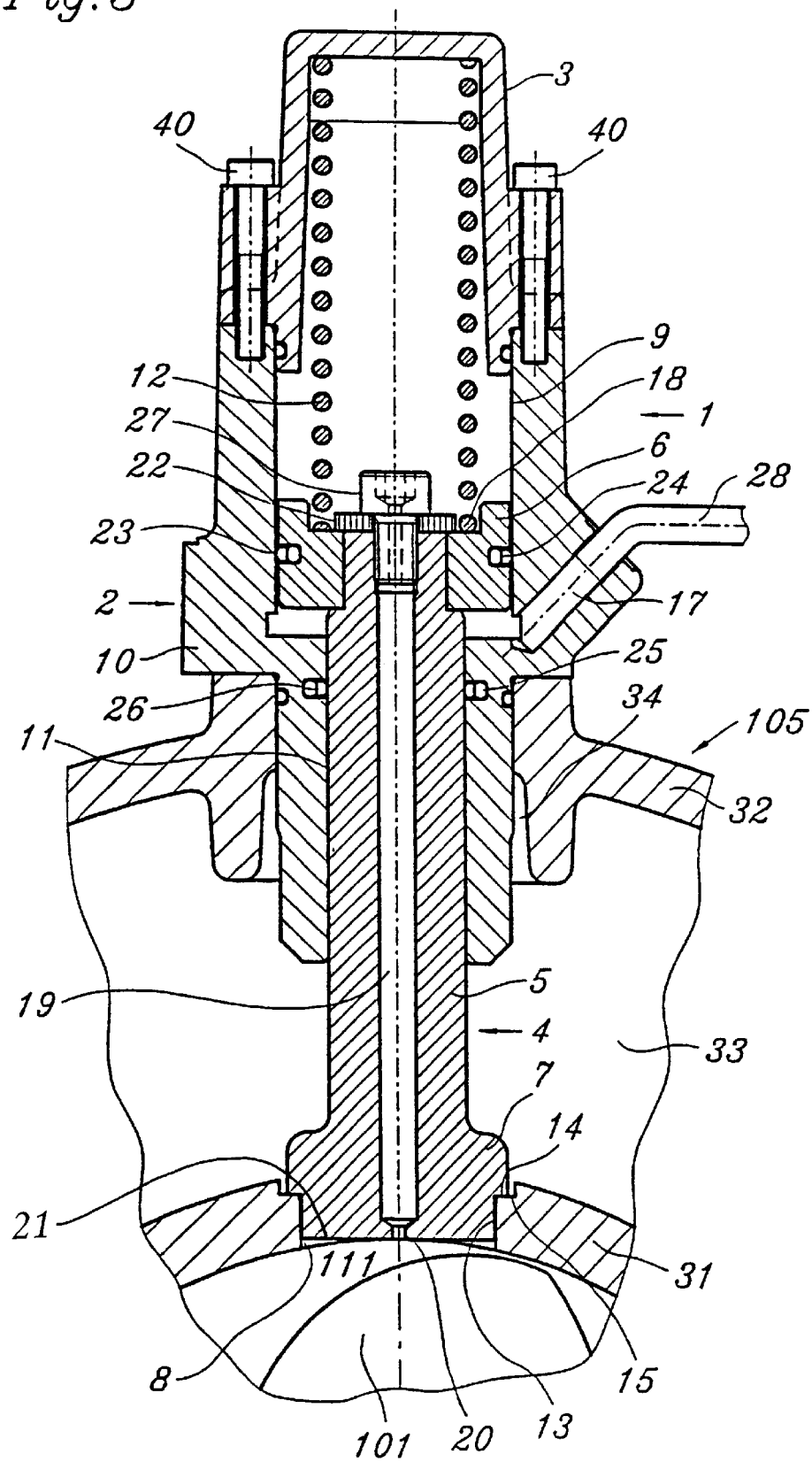
FIG. 3 is a sectional view of part of an inventive helical screw compressor with a lift valve shown in longitudinal section.

FIG. 3 shows in larger scale the barrel wall 105 of the helical screw compressor shown in FIG. 1, and also shows a lift valve I disposed in said wall. In the region nearest the lift valve 1, the barrel wall 105 includes an inner barrel wall 31 which surrounds a rotor 101, and an outer barrel wall 32 which is spaced from said inner barrel wall. The walls 31, 32 define an intermediate space which forms a fluid passageway 33. The fluid passageway or duct 33 is connected with the compressor inlet 108 or a compressor working chamber whose connection with the inlet 108 is still intact.

The inner barrel wall 31 delimits the compressor working room in which the two mutually co-acting screw rotators 101, 102 (FIG. 1) are mounted. The lift valve 1 is mounted radially outwards from the cylindrical working room in a region in which a closed working chamber is situated, for instance 111 or 112 in FIG. 2.

The barrel wall 105 includes a first opening 8 in the inner wall 31 and a second opening 34 in the outer wall 32. The opening 34 in the outer wall 32 accommodates a valve housing 2 which houses a reciprocatingly moveable valve element 4. The valve element 4 includes a valve stem 5, a head 6 on one end of said stem, and a valve body 7 at the other end of said stem 5. Large parts of the valve stem 5 and the valve body 7 are located outside the valve housing 2.

The valve head 6 has the form of an annular element which is threaded over the end of the valve stem 5 in the valve housing and screwed firmly to the stem with the aid of a washer 22 and a threaded sleeve 27.

The valve housing 2 is delimited laterally by an internal, cylindrical side wall 9 and upwardly by a cap 3 and downwardly by a bottom part 10. The cap 3 is secured firmly in the side wall by means of bolts 40. The bottom part 10 has a cylindrical bore 11 along which the valve stem 5 can move with a slight clearance.

The head 6 of the valve element 4 and the valve stem 5 can move with a small amount of clearance along the cylindrical side wall 9 of the valve housing 2 and the opening 11 in the bottom part 10, respectively. The valve head 6 includes a ring-shaped groove 23 which accommodates a sealing ring 24. Sealing of the working chamber of the valve housing 2 against the fluid passageway 33 is achieved with the aid of a cylindrical groove 25 in the opening 34 of said bottom part 10 and a sealing ring fitted in said groove. The sealing rings 24 and 26 may be O-rings.

An elastic device 12 is disposed between the cap 3 and the valve head 6. The elastic device 12 has the form of a helical compression spring in the illustrated case. The bottom end of the elastic device 12 rests in a recess 18 in the head 6. The device 12 is intended to force the valve element 5 away from the cap 3 and into a first end position of the valve body 7, with a predetermined force.

The free end of the valve body 7 has a cylindrical shape 13 and merges with a flange 14. The diameter of the cylindrical part 13 is smaller than the diameter of the cylindrical opening 8, such as to provide a small clearance therebetween. The inner wall 31 includes on the side thereof which delimits the fluid passageway 33 in the region around the opening 8 a surface area 15 for abutment with the flange 14. This surface area 15 constitutes the first end position of the valve element 4, i.e. it is the first end position.

The end area of the cylindrical part 13 forms a valve area 21 which faces towards a compressor compression chamber 111 (112). The cylindrical part 13 has a length which will ensure that it will not project into the cylindrical working chamber of the compressor and will not therefore prevent rotation of the rotor 101 when the flange 14 on the valve body 7 lies against the surface area 15. The valve element 4 is in its first end position when said flange abuts said surface area. In this end position of the valve element, the end surface of the cylindrical part 13 will preferably be tangential to the barrel surface in the opening 8 along its diameter parallel with the rotor axis. The cylindrical part 13 may, alternatively, have a somewhat shorter length. According to one alternative embodiment, the end of the valve body 7 has a cylindrical curved end surface that has the same radius of curvature as the inner wall 31. When the valve body 7 is located in its first end position, this curved end surface forms a unitary surface with the barrel wall 31. In this embodiment, including a curved end surface, it is necessary to ensure that the valve body 7 is unable to rotate along its long axis away from the position in which it forms a unitary surface area with the valve wall 31. The construction of a valve element that is unable to rotate about its long axis is described in Swedish Patent Application 9703164-5.

The length of the valve stem 5 is such that the valve head 6 will be spaced from the bottom part 10 of the valve housing 2 when the flange 14 is in abutment with the surface area 15. The reason why this is so will be described hereinafter.

The valve element 4 includes a passageway 19 which extends through said element along its centre axis. One end of the passageway 19 is formed by the threaded sleeve 27. The passageway 19 connects the working chamber 111, 112 of the cylindrical working room of the compressor with the interior of the valve housing 2. This provides a connection between the working chamber 112 of the cylindrical working room of the compressor and the space above the valve element 4, so that the same pressure will act on both sides of the valve element 4. The passageway 19 will preferably include a constriction or like throttle means as shown at 20.

An opening 17 is provided in the wall of the valve housing 10, adjacent its bottom part 10. Because the valve head 6 is always spaced from the bottom part 10 of the valve housing 2, this placement of the opening 17 will mean that said opening will always be located between the bottom part 10 and the valve head 6 even when the valve element 4 is in its first end position. The opening 17 forms one end of a passageway 28, of which only that part nearest the opening 17 is shown and which can be connected alternately with either an outlet passageway or compressor chamber in which an outlet pressure prevails, or with an inlet passageway or a compressor chamber in which an inlet pressure prevails.

The lift valve 1 is closed when the compressor runs at full load. The valve body 7 is then located in its first end position, with the flange 14 in abutment with the surface area 15. The opening 17 in the valve housing 2 is then connected with a working chamber where inlet pressure prevails, or with the inlet 108. In this position, the valve body is subjected to forces that act towards the first position, these forces being the pressure force exerted by the elastic device 12 and the force resulting from the pressure in the space above the valve element 4 and the surface area of the valve head 6. This force is greater than the forces acting on the valve element 4 in the opposite direction. These counteracting forces are comprised partly of the force acting on the valve surface 21 of the valve element 4 and are a function of the size of the valve area in addition to the pressure, and partly by the force exerted by the pressure prevailing in the opening 17, this pressure being equal to the compressor inlet pressure. This latter force corresponds to the size of the area on which the pressure acts and on the magnitude of the pressure.

The opening 17 is connected to outlet pressure, when wishing to remove the load on the compressor. This results in an increase in the force acting on the valve element 4 in a direction away from said first end position. The elastic device 12 must therefore actuate the valve element with a force such that the change in the pressure ratio will enable the valve element 4 to be moved from said first position when the opening 17 is connected to outlet pressure. This displacement enables air to flow from the closed chamber and through the fluid passageway 33 to said inlet.

Figure 4:
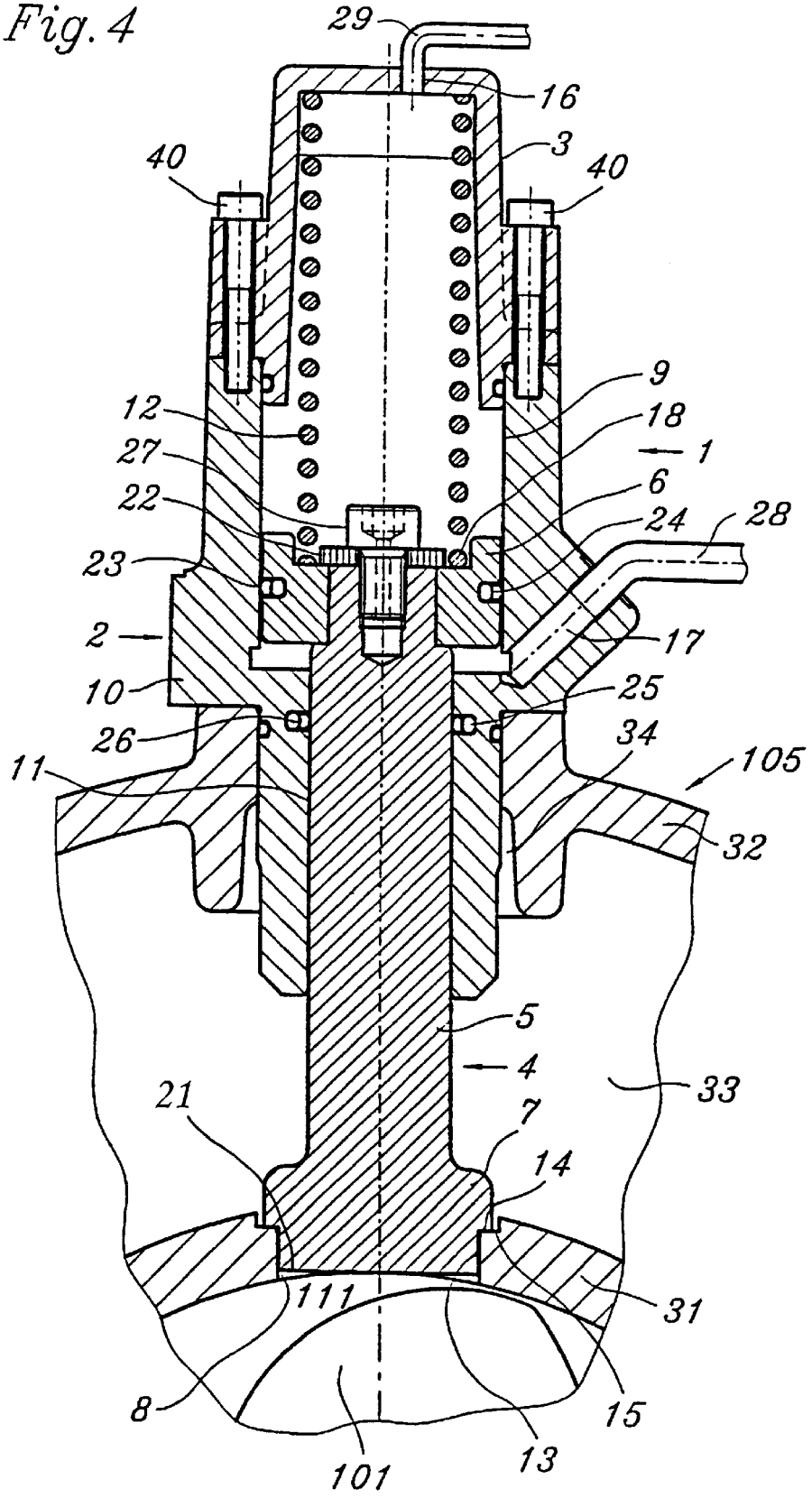
FIG. 4 is a sectional view of part of an inventive helical screw compressor with another embodiment of an inventive lift valve shown in longitudinal section.

FIG. 4 illustrates another embodiment of an inventive lift valve. This embodiment differs from the FIG. 3 embodiment by virtue of the fact that the passageway 19 through the valve element 4 is replaced with a passageway 29, only a part of which is shown. This passageway 29 terminates in an opening 16 in the cap 3. The other end (not shown) of the passageway 29 is connected to the closed working chamber 111 (112) in the valve housing 1. The passageway 29 will also preferably include a constriction or like throttle means corresponding to the throttle means 20 in the passageway 19.

The lift valve according to this embodiment functions in the same way as that described with reference to FIG. 3.

What is claimed is:

1. A variable capacity helical screw compressor that includes at least one lift valve (1) which connects with a compression chamber (111; 112) of the compressor and which includes a valve housing (2) that includes an internal cylindrical side wall (9), a bottom (10) provided with a bottom opening (11), and a cap (3);

a valve element having a valve head (6) which can move reciprocatingly in the valve housing (2);

a valve stem (5) whose one end is connected to the valve head (6) and whose other end projects out through the bottom opening (11) in the valve housing (2);

a valve body (7) having a valve area (21) at the other end of the valve stem (5), said valve area (21) facing towards the compression chamber (111; 112); and a displacement means for moving the valve head (6) in the valve housing (2), said displacement means comprising a first passageway (28) that has an opening (17) at a first end which opens into the valve housing (2) adjacent a first side of the valve head (6) and that is in selective fluid contact at a second end either with an outlet passageway or a compressor chamber where outlet pressure prevails, or with an inlet passageway or a compressor chamber where inlet pressure prevails; and a second passageway (19; 29) which connects the valve housing (2) in or adjacent to a second, opposite side of the valve head (6) to a compression chamber (111, 112), wherein that an elastic device (12) is disposed between the second side of the valve head (6) and the cap (3) of said valve housing (2).

2. A compressor according to claim 1, wherein that the elastic device (12) is a spring.

3. A compressor according to claim 1, wherein that the second passageway (19) is provided in the valve element (4) and extends from the valve head (6) to the valve area (21) on the opposite side of the valve stem (5) of said valve element (4).

4. A compressor according to claim 1, wherein that the second pressure passageway (19) includes a throttle (20).

5. A compressor according to claim 2, wherein that the second passageway (19) is provided in the valve element (4) and extends from the valve head (6) to the valve area (21) on the opposite side of the valve stem (5) of said valve element (4).

6. A compressor according to claim 2, wherein that the second pressure passageway (19) includes a throttle (20).

7. A compressor according to claim 3, wherein that the second pressure passageway (19) includes a throttle (20).

8. A compressor according to claim 5, wherein that the second pressure passageway (19) includes a throttle (20).

* * * * *